United States Patent [19]

Kachur et al.

[11] 4,353,475

[45] Oct. 12, 1982

[54] SAFETY CLOSURE DEVICE

[75] Inventors: Nicholas W. Kachur, Clark; Anthony F. Tomburo, Cranford, both of N.J.

[73] Assignee: Gibson Associates Inc., Cranford, N.J.

[21] Appl. No.: 273,100

[22] Filed: Jun. 11, 1981

[51] Int. Cl.[3] ..... B65D 55/02

[52] U.S. Cl. ..... 215/223; 215/217; 215/218; 215/222

[58] Field of Search ..... 215/211, 217, 218, 222, 215/223

[56] References Cited

U.S. PATENT DOCUMENTS

| | | | |
|---|---|---|---|
| 4,032,028 | 6/1977 | Reiss et al. | 215/223 X |
| 4,091,948 | 5/1978 | Northup | 215/222 |
| 4,139,112 | 2/1979 | Cooke | 215/222 X |

*Primary Examiner*—George T. Hall

*Attorney, Agent, or Firm*—Hopgood, Calimafde, Kalil, Blaustein & Judlowe

[57] ABSTRACT

The invention contemplates safety-closure structure involving threaded engagement of cap and bottle-neck members, wherein coacting lug formations on the respective members have compliantly yieldable cammed latching engagement in approach to a fully-closed relation of the members and wherein, once in the fully-closed relation, a positive-lock relation prevents unthreading rotation of the members. The engaged threads are sized for a quantum of axial lost-motion, and resilient action of a seal which reacts axially between the members is operative to constantly load the cap member to its axially upper limit of the lost motion. The lug formations are of such axially limited extent that, when the members are in their fully-closed relation, an axial depression of the cap member through the lost motion and against the resilient seal action is necessary to free the positive-lock relation of the lugs formations, thus then permitting a thread-off rotary manipulation of the cap member.

6 Claims, 8 Drawing Figures

SAFETY CLOSURE DEVICE

BACKGROUND OF THE INVENTION

The invention relates to a safety-closure device of the variety in which a cupped closure cap has thread-on, thread-off engageability with respect to the neck of a bottle or other container.

For child-safety purposes, it is desirable that such closure devices shall require an additional actuation, i.e. other than merely an un-threading rotation, in order to dislodge the cap from the container neck. Prior devices of this general character have relied on plural angularly spaced self-locking bayonet engagements wherein only a relatively small cap-to-neck rotation is operative to make the closing engagement; such devices have used squeezability, axially compliant compressed displacement and axially compliant tensed displacement as the various additional actuations needed to effect release from a locked closed position. But we have no knowledge of a satisfactory additional unlocking actuation such as a push-to-release actuation, embodied in a full-thread cap-to-neck engagement, i.e. an engagement involving at least one full turn of threaded engagement.

BRIEF STATEMENT OF THE INVENTION

It is an object of the invention to provide a safety closure of the full-thread variety wherein the fully closed relation is dogged against thread-off rotation unless the cap has first been downwardly displaced.

A specific object is to achieve the foregoing object without encountering dog interference until substantial thread-on accomplishment of a fully closed position of the cap.

Another specific object is to meet the above objects in the context of a circumferentially sealed relation of parts, at full closure, without impairing seal effectiveness.

A general object is to meet the above objects with simple structural features which do not involve additional parts, beyond the cap part and the container-neck part.

The invention achieves the above objects and other features by providing coactive lug formations on the respective cap and neck parts. These lug formations have compliantly yieldable cammed latching engagement in approach to a fully-closed relation of the parts and, once in the fully-closed relation, a positive-lock relation prevents unthreading rotation of the parts. The engaged threads are sized for a quantum of axial lost-motion, and resilient action of a seal which reacts axially between the parts is operative to constantly load the cap part to its axially upper limit of lost motion. The lug formations are of such axially limited extent that, when the parts are in their fully-closed relation, an axial depression of the cap part through the lost motion and against the resilient seal action is necessary to free the positive-lock relation of the lug formations, thus then permitting a thread-off rotary manipulation of the cap part.

DETAILED DESCRIPTION

A preferred embodiment of the invention will be described in detail in conjunction with the accompanying drawings, in which.

Figures 1, 2, 3, 4, 5, 6, 7, 8:
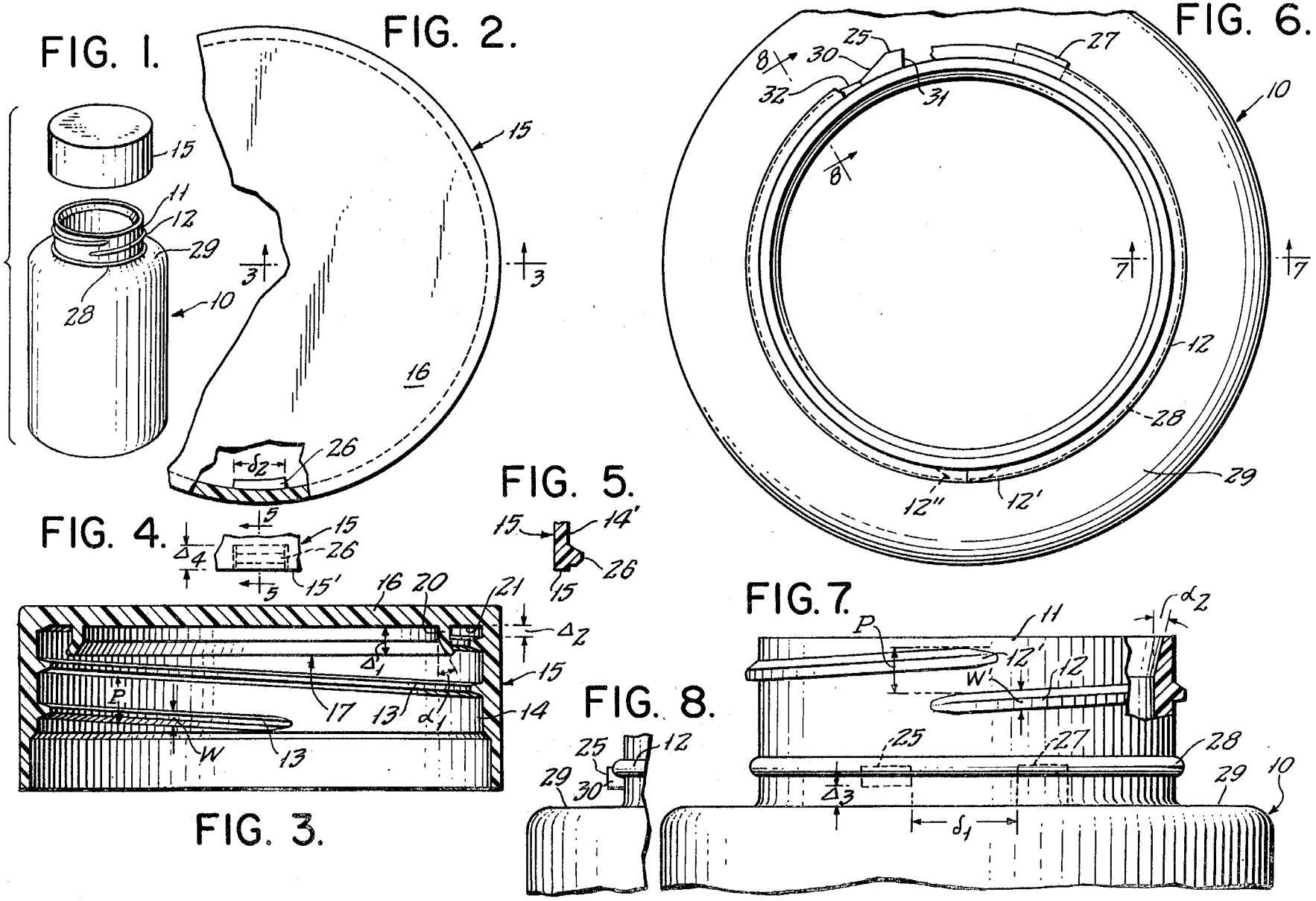
FIG. 1 is an exploded view in perspective of a cap and container embodying the invention.
FIG. 2 is a fragmentary plan view of the cap of FIG. 1, partly broken-away to reveal a lug formation of the invention.
FIG. 3 is a sectional view taken at 3—3 of FIG. 2.
FIGS. 4 and 5 are fragmentary side elevation and sectional views, respectively, of the lug formation of FIG. 2, FIG. 5 being taken at 5—5 of FIGS. 2 and 4.

FIGS. 6 and 7 are partly broken-away plan and side elevation views, respectively, of the neck of the container of FIG. 1, the broken-away part of FIG. 7 being in section at the line 7—7 of FIG. 6; and FIG. 8 is a fragmentary view in elevation, taken from the aspect 8—8 of FIG. 6.

The invention is illustratively embodied in a bottle or the like container 10 having a reduced cylindrical neck 11 having substantially a single turn of an external thread 12. Thread 12 has removable engagement to a similar but internal thread 13 (FIG. 3) in the cylindrical bore 14 of a closure cap 15 having a closed upper end 16; thread 13 happens to be shown for substantially two turns, but substantially only the lower full turn is used, when fully engaged to the neck thread 12. The effective width W of thread 13 (in the direction of the central axis of thread engageability) is less than half the pitch P of the thread 13 helix, and the same may be said of the width W′ in relation to the identical pitch P of the external neck thread 12 (FIG. 7); these relationships establish a quantum of axial lost motion in the engaged condition of threads 12–13, as will be understood.

Integrally formed with and dependent from the inner surface of the closed end 16 of the cap is a peripherally continuous annular seal formation 17 having a relatively thin flexible outwardly flaring frusto-conical lip 18, for continuous wiping engagement with an outwardly flared counterbore 19 at the open end of the bottle neck 11; the remaining body 20 of seal formation 17 is thicker, to provide firm reference and an axial offset $\Delta$, for the counterbore-contacting rim of flexible lip 18. The flare angle $\Delta_1$, of lip 18 preferably exceeds and is in the opposite sense of the flare angle $\alpha_2$ of counterbore 19; suitably, these angles are substantially 30° and 12°, respectively.

It will be recognized from the foregoing that in the course of thread-on engagement of cap 15 to neck 11, lip 18 establishes circumferentially continuous wiping (sealing) contact with counterbore 19 and that this contact gradually develops increasing radially inwardly compressed deflection of the lip 18, until achievement of the full-closure angular relationship, at substantially one full turn of thread 12–13 engagement, at which point the upper open end of neck 11 is, to the extent $\Delta_2$ short of abutment with that annular part 21 of the inner surface of the closed end 16 which is in the space between seal 17 and the cap bore 14. In this relation, relatively great compliant reaction force loads the circumferential seal, and there is an axially upward component of the compliantly loaded seal action. This axially upward component provides a residual axially upward loading of the cap thread 13 against the underside of the neck thread 12, i.e., to the upper limit of the axial lost-motion inherent in the stated dimensional relation of thread width to thread pitch. The clearance $\Delta_2$ exists to permit a deliberate press-down actuation (axial displacement) of cap 15 with respect to neck 11, in order to release a safety lock, described below.

The safety-lock feature utilizes coacting integral lug formations 25–26–27 of the cap and neck, so that the cap 15 and neck 11 remain the sole parts for achieving threaded and safety-locked closure of the container 10. Two of these lug formations 25–27 are on one of the cap and neck members, the third lug formation 26 is on the other of these members; in the preferred form shown, the two lugs 25–27 are integral radially outward angularly spaced formations of neck 11, being preferably diametrically offset from the short lap of upper and lower ends 12'–12'' of the neck thread 12. Lugs 25–27 are angularly spaced to the extent $\delta_1$, at least as great as the effective angular width $\delta_2$ of the coacting lug formation 26 in the bore 14 of cap 15. Lugs 25–27 are axially positioned below the thread 12, being shown integral with a circumferential bead 28 of the neck finish, at offset from the nearby shoulder 29 of the bottle 10. The operative lower edge of lug 25 must axially clear shoulder 29 to an extent $\Delta_3$ which equals or exceeds the extent $\Delta_4$ (FIG. 4) by which the operative upper edge of lug 26 is offset from the lower edge 15' of cap 15. And, preferably, the axial extent of lug 27 is for the full distance to shoulder 29, so as always to define a stop for thread-on cap rotation, regardless of whether cap 15 is or is not depressed, when the container is to be deemed fully closed and sealed.

The described cap-to-neck engagement will be seen to be one in which the potential exists for greater thread-on advancing engagement of threads 12–13, beyond their initial full turn of engagement, were it not for the positive stop which is achieved when lug 26 is intercepted by lug 27. By having lugs 26–27 positioned to stop thread-on rotation at this position, it is assured that the clearance $\Delta_2$ and the clearance from the lower edge 15' of the cap to container shoulder 29 will provide such sufficient extent of the lost-motion inherent in the described thread relation, as to permit a lug-disengaging depression of cap 15, enabling simple thread-off rotation.

In order for lug 26 to reach its full-stop position of abutment with stop lug 27, it (lug 26) must first engage the radially outwardly camming slope 30 of lug 25, being thereby transiently outwardly urged until continued thread-on rotation brings lug 26 past the sharply inward trailing edge 31 of lug 25. Once past edge 31, lug 26 snaps into locked position between lugs 25–27. As best seen in FIG. 6, the neck bead 28 is locally reduced in radial "height" at a down ramp 32, just prior to slope 30, in order to avoid interference between lug 26 and bead 28, in the thread-on approach of lug 26 to slope 30; also, for this same reason, bead 28 does not exist in the angular interval between ramp 32 and stop lug 27.

It will be seen that the described thread and lug configurations meet all stated objects. Importantly, the transient radially outward camming of lug 26 is achieved without introduction of any substantially axial component of latch-action force, so that, in the course of the transient radially outward deformation involved, there is virtually no upsetting of the circumferentially extensive thread engagement (12–13) and hence no upsetting of the circumferentially continuous seal contact (18–19) which is responsible for stabilizing reference to the thread engagement.

What is claimed is:

1. In combination, safety-closure structure comprising a bottle or the like container having a cylindrical neck member with an external thread of at least substantially one turn, a cup-shaped closure-cap member with a cylindrical bore wall having an internal thread of at least substantially one turn and removably engageable with said external thread, the effective width of each of said threads in the axial direction being less than half the helically advancing pitch of said threads, resilient circumferentially extending continuous seal means within said cap member and coacting with said neck member throughout at least a substantial fraction of the threaded engageability of said cap and neck members, said fraction being to and including an angular cap-to-neck relation wherein cap-member closure of said neck member is complete, whereby said seal means continuously loads the cap threads into axially upward engagement with the axial underside of the neck threads at least in on-threading approach to said angular relation of completed cap-member closure of said neck member, a radially inward locking lug integral with the bore wall of said cap member and axially offset from said internal thread, and a radially outward locking lug integral with said neck member and axially offset below said external thread, said lugs having cammed transiently deforming interaction upon approach to said completed-closure relation and escaping into a locking interaction upon achievement of said completed closure position, said neck lug and cap lug being of such limited axial extent that, when in the completed-closure relation, said cap member may be axially downwardly displaced in further compression of said seal means to angularly clear the engagement of said lugs thereby to permit otherwise-free unthreading manipulation of said cap member.

2. The combination of claim 1, in which the lug on one of said members is one of a pair of angularly spaced integral lugs on said one member, said pair of lugs angularly straddling the lug of the other member when in the completed-closure relation, the second lug of said pair being in rotationally dogging relation to said other-member lug for attempted further advance of thread engagement beyond said completed-closure relation.

3. The combination of claim 2, in which said second lug of said pair is of such effective axial extent as to be in said rotationally dogging relation whether or not said cap member is axially downwardly displaced when in said completed closure relation.

4. The combination of claim 2, in which said one member is said neck member.

5. The combination of claim 1, in which said threads have substantially only one full turn of engageability between said completed-closure relation and total disengagement of said threads.

6. The combination of claim 5, in which said seal means comprises an integrally formed frusto-conical lip which flares outwardly from the inner surface of the closed end of said cap member, said neck member having a bore with an outwardly flaring counterbore of such axial extent as to continuously engage and progressively compress said lip throughout the course of said substantially one full turn of engageability.

* * * * *